US011019907B2

(12) United States Patent
Martines et al.

(10) Patent No.: US 11,019,907 B2
(45) Date of Patent: Jun. 1, 2021

(54) VIAL WITH NECK FOR A LIQUID PRODUCT

(71) Applicant: QUALIPAC, Clichy (FR)

(72) Inventors: Gérald Martines, Paris (FR); Marc Delmon, Ytrac (FR)

(73) Assignee: QUALIPAC, Clichy (FR)

( * ) Notice: Subject to any disclaimer, the term of this patent is extended or adjusted under 35 U.S.C. 154(b) by 0 days.

(21) Appl. No.: 15/548,344

(22) PCT Filed: Feb. 3, 2016

(86) PCT No.: PCT/FR2016/050228
§ 371 (c)(1),
(2) Date: Aug. 2, 2017

(87) PCT Pub. No.: WO2016/124859
PCT Pub. Date: Aug. 11, 2016

(65) Prior Publication Data

US 2018/0014623 A1 Jan. 18, 2018

(30) Foreign Application Priority Data

Feb. 3, 2015 (FR) ..... 15 50840

(51) Int. Cl.
*B65D 8/00* (2006.01)
*B65D 25/04* (2006.01)
(Continued)

(52) U.S. Cl.
CPC ..... *A45D 34/02* (2013.01); *B05B 11/3043* (2013.01); *B05B 11/3047* (2013.01);
(Continued)

(58) Field of Classification Search
CPC ..... B65D 15/02; B65D 25/04; B05B 11/3043; B05B 11/3047; B05B 11/3084; B05B 11/0037; A45D 34/02
(Continued)

(56) References Cited

U.S. PATENT DOCUMENTS 3,215,304 A * 11/1965 Rohe ..... H01M 2/0439 220/359.1
4,290,536 A * 9/1981 Morel ..... B62D 25/24 220/359.4
(Continued)

FOREIGN PATENT DOCUMENTS

EP 0 426 580 A1 5/1991
EP 1 394 052 A1 3/2004
(Continued)

OTHER PUBLICATIONS

Internationa Search Report related to Application No. PCT/FR2016/050228 reported dated May 13, 2016.

*Primary Examiner* — J. Gregory Pickett
*Assistant Examiner* — Niki M Eloshway
(74) *Attorney, Agent, or Firm* — von Briesen & Roper, s.c.

(57) ABSTRACT

The present invention concerns a vial with a neck for a liquid product with an external shape, comprising: a part made from glass, said part made from glass comprising an annular assembly surface; a rigid piece having an annular assembly surface; a neck formed on the part made from glass or the rigid piece; a neck providing a fluid seal either between the annular assembly surface of the part made from glass and the annular assembly surface of the rigid piece, or between the annular assembly surface of the part made from glass and a sealing band, the sealing band being rigidly connected to the annular assembly surface of the rigid piece, thus providing
(Continued)

the fluid seal, the part made from glass, the rigid piece and the neck giving the vial the external shape of same.

14 Claims, 11 Drawing Sheets

(51) Int. Cl.
*A45D 34/02* (2006.01)
*B05B 11/00* (2006.01)

(52) U.S. Cl.
CPC ..... *B05B 11/3084* (2013.01); *B65D 15/02* (2013.01); *B65D 25/04* (2013.01); *B05B 11/0037* (2013.01)

(58) Field of Classification Search
USPC ..... 215/40; 220/359.1, 359.2, 319, 359.4, 220/364, 612
See application file for complete search history.

(56) References Cited

U.S. PATENT DOCUMENTS 4,583,656 A * 4/1986 MacLaughlin ..... B65D 41/14 220/359.4
4,728,003 A * 3/1988 Davey ..... B65D 43/0216 220/319
5,427,268 A * 6/1995 Downing, Jr. ..... B01J 3/03 220/581
5,582,318 A * 12/1996 Dietrich ..... B65D 7/40 220/319
5,697,514 A * 12/1997 Hekal ..... B65D 77/2008 220/359.1
6,578,723 B1 * 6/2003 Tyner ..... B65D 55/06 215/232
8,256,631 B2 * 9/2012 Hoffmann ..... A61J 1/062 215/251
8,770,428 B2 * 7/2014 Brauer ..... B65B 7/01 215/232
2003/0183636 A1 * 10/2003 Shih ..... B65D 43/0218 220/359.1
2004/0094551 A1 * 5/2004 Mavin ..... B29C 65/5057 220/258.2
2004/0232150 A1 * 11/2004 John P. ..... B65D 43/0216 220/319
2006/0151424 A1 * 7/2006 Nakada ..... B65D 39/0058 215/354
2012/0270167 A1 * 10/2012 Sato ..... C30B 15/10 432/13
2015/0298831 A1 * 10/2015 Huels ..... B29C 65/18 53/471
2016/0046422 A1 * 2/2016 Grell ..... B65D 77/2024 220/254.3
2016/0167850 A1 * 6/2016 Mclaren ..... B65D 49/12 215/253
2017/0028421 A1 * 2/2017 Martines ..... B05B 11/0037

FOREIGN PATENT DOCUMENTS

FR R2 845 357 A1 4/2004
FR 2 989 671 A1 10/2013
FR 3024715 A1 * 2/2016 ..... B05B 11/0037

* cited by examiner

| Possible combinations | | | | | Glass part | | | | | | | | | | | |
|---|---|---|---|---|---|---|---|---|---|---|---|---|---|---|---|---|
| | | | | | P | | | | | PL | | | | | | |
| | | | | | s/SAI | | | a/SAI | | s/PI | | | a/PI | | | |
| | | | | | s/C | a/1C | a/2C | s/C | a/2C | a/1F | a/1D1C | a/1D2C | a/1F | a/2F | a/1D | a/2D |
| Rigid part | P | s/SAI | s/C | | non | non | non | non | non | non | oui | oui | non | non | oui (s/C×2) | oui (s/C×2) |
| | | | a/1C | | non | non | non | non | non | oui | non | non | oui (a/1C×2) | oui (a/1C×2) | non | non |
| | | | a/2C | | non | non | non | non | non | oui | non | non | non | non | non | non |
| | | a/SAI | s/C | | non | non | non | non | non | non | non | non | non | non | oui | non |
| | | | a/2C | | non | non | non | non | non | non | non | non | oui | non | non | non |
| | PL | s/PI | a/1F | | non | oui | oui | non | non | non | oui | oui | non | non | oui (a/1F×2) | oui (a/1F×2) |
| | | | a/1D1C | | oui | non | non | non | non | oui | non | non | oui (a/1D1C×2) | oui (a/1D1C×2) | non | non |
| | | | a/1D2C | | oui | non | non | non | non | oui | non | non | non | non | non | non |
| | | a/PI | a/F | a/1F | non | oui (a/1C×2) | non | non | oui | non | oui (a/1D1C×2) | non | non | non | oui | non |
| | | | | a/2F | non | oui (a/1C×2) | non | non | non | non | oui (a/1D1C×2) | non | non | non | non | non |
| | | | a/D | a/1D | oui (s/C×2) | non | non | oui | non | oui (a/1F×2) | non | non | oui | non | non | non |
| | | | | a/2D | oui (s/C×2) | non | non | non | non | oui (a/1F×2) | non | non | non | non | non | non |

FIG. 13 key: oui = yes
non = no

VIAL WITH NECK FOR A LIQUID PRODUCT

CROSS-REFERENCE TO RELATED APPLICATION

This Application is a 35 USC § 371 US National Stage filing of International Application No. PCT/EP2016/050228 filed on Feb. 3, 2016, and claims priority under the Paris Convention to French Patent Application No. 15 50840 filed on Feb. 3, 2015.

FIELD OF THE DISCLOSURE

The present invention relates to a bottle for a liquid product, particularly a cosmetic or perfume product. The bottle is formed of two parts, one of glass and the other of a rigid material. The two parts are assembled in a fluidtight manner to form the bottle.

BACKGROUND OF THE DISCLOSURE

In the field of packaging, it is conventional to create a glass bottle by blow molding. In such a case, a bottle having a tubular neck of narrow dimensions is created, which can be sealed closed by any suitable means. As the dimensional precision of such a blowing process is quite low, the sealing solution needs to be oversized. The seal is facilitated by the small size of the opening, which make it easy to oversize the sealing solution to ensure a sufficiently fluidtight result for the desired application. One example can be found in U.S. Pat. No. 6,158,604, for example. However, glass blow molding is a technique which only provides control of the external form given to the bottle. It is therefore common for a glass bottle resulting from a blow molding process to have an uncontrolled irregular internal shape, particularly when the blow molding is carried out so that the bottle has a polygonal external shape.

However, control of the inner shape of glass bottles is increasingly in demand, particularly in perfumery and in the cosmetics and spirits industries where the aesthetics of the packaging plays a particularly important role.

There is an alternative technique for creating a glass container, which enables control of both the external shape and the internal shape. This alternative technique is glass pressing. However, the creation of a pressed glass container does not make it possible for the container to have a tubular neck with narrow dimensions, which is necessary for receiving a dispenser, as is the case when the bottle is of blown glass. A container made of pressed glass conventionally defines an opening of large dimensions, similar in size to those of a forming die, and cannot form a bottle.

It is known from the prior art to close a container of pressed glass by means of a threaded lid with a ring-shaped gasket to seal the packaging device. However, such a solution is limited to the production of containers comprising a circular opening.

It is also known from the prior art to close a plastic container by snap-fastening a lid. U.S. Pat. No. 3,223,278 provides an example of such an embodiment. However, glass does not make it possible to control manufacturing tolerances as well as for plastic. It would therefore be difficult to transpose such a solution to a glass container to ensure sealing of the packaging device.

Lastly, it is known from the prior art to create a bottle from a first piece of pressed glass and a second piece of an elastically deformable material. WO 2014/053793 describes an example of such an embodiment. However, given the non-circular geometry of the opening, closure piece, and locking piece, the parts in contact between the bottle of pressed glass and the closure piece are not uniformly stressed. Furthermore, although this solution is satisfactory, the shape of the perimeter of the opening of the pressed glass piece where a bead is provided and the shape of the closure piece where a relief is provided is quite complex and bulky.

SUMMARY OF THE DISCLOSURE

The present invention proposes an alternative solution suitable for packaging devices comprising a glass bottle of any shape, in particular a connection solution that is simpler to implement and less bulky.

More specifically, an object of the present invention is a bottle with neck for a liquid product, having an external shape, comprising:

- a glass piece, said glass piece having an annular assembly surface;
- a rigid piece having an annular assembly surface;
- a neck formed on the glass piece or rigid piece;
- an adhesive providing a fluidtight seal either between the annular assembly surface of the glass piece and the assembly surface of the rigid piece, or between the annular assembly surface of the glass piece and a sealing band, the sealing band being securely connected to the annular assembly surface of the rigid piece and thereby ensuring the fluidtight seal, the glass piece, rigid piece, and neck giving the bottle its external shape.

Such a bottle has the advantage of being made using a glass piece, in particular made of pressed or pressed-and-blown glass, and another piece which is rigid, while simplifying the provision of the fluidtight sealing between the two parts. Indeed, given the fact that the solution uses an adhesive, no bead or relief for mechanical assembly is required to make the bottle, which facilitates the manufacture of the two parts of the bottle and eliminates the need for a locking piece which would be required for a snap-closure solution. Furthermore, the adhesive ensures the fluidtight sealing and no ring seal is required. Finally, this solution allows creating glass pieces having an opening that is non-circular and non-planar (not inscribed in a plane).

In one embodiment, the glass piece comprises a side wall, an annular edge of which forms an opening, the annular assembly surface being located on the annular edge forming the opening. In addition, the annular edge forming the opening may have a shoulder in which the annular assembly surface is formed.

In another embodiment, the adhesive is a silicone adhesive.

In another embodiment, the assembly surface of the glass piece faces the annular assembly surface of the rigid piece, and the adhesive is placed therebetween. In addition, the rigid piece may comprise an annular flange on which the annular assembly surface of the rigid piece is provided.

In another embodiment, the bottle comprises a glue trap on the annular assembly surface of either the glass piece or rigid piece or is distributed between the glass piece and rigid piece. In addition, the glue trap may have a filling groove for depositing adhesive, at least one bonding surface, and at least one overflow groove, the filling groove, the bonding surface, and the overflow groove being substantially concentric.

In another embodiment, the sealing band comprises two concentric annular portions, a first sealing portion for the annular assembly surface of the glass piece and a second sealing portion for the annular assembly surface of the rigid piece, and the annular assembly surfaces of the glass piece and rigid piece are substantially adjacent and substantially in the same plane.

In another embodiment, the annular assembly surfaces of the glass piece and rigid piece are oriented collinearly to the direction of assembly of the glass piece with the rigid piece.

In another embodiment, the annular assembly surfaces of the glass piece and rigid piece are oriented in a direction forming, with a direction of assembly of the glass piece with the rigid piece, an acute angle that is substantially non-zero, preferably substantially equal to 90°.

The embodiments described above may advantageously be combined.

In another aspect of the invention, a packaging device for a liquid product is provided, comprising a bottle as described above and a dispenser of liquid product.

In yet another aspect of the invention, a method for manufacturing the bottle is provided.

BRIEF DESCRIPTION OF THE DRAWINGS

The invention will be better understood from the following description and the accompanying figures. These are merely illustrative and are in no way limiting to the invention. The figures show:

FIG. 13: a table summarizing the possible combinations of the pieces shown in FIGS. 3 to 12;

In the various figures, the same references designate identical or similar elements.

DETAILED DESCRIPTION OF THE DISCLOSURE

Figure 1:
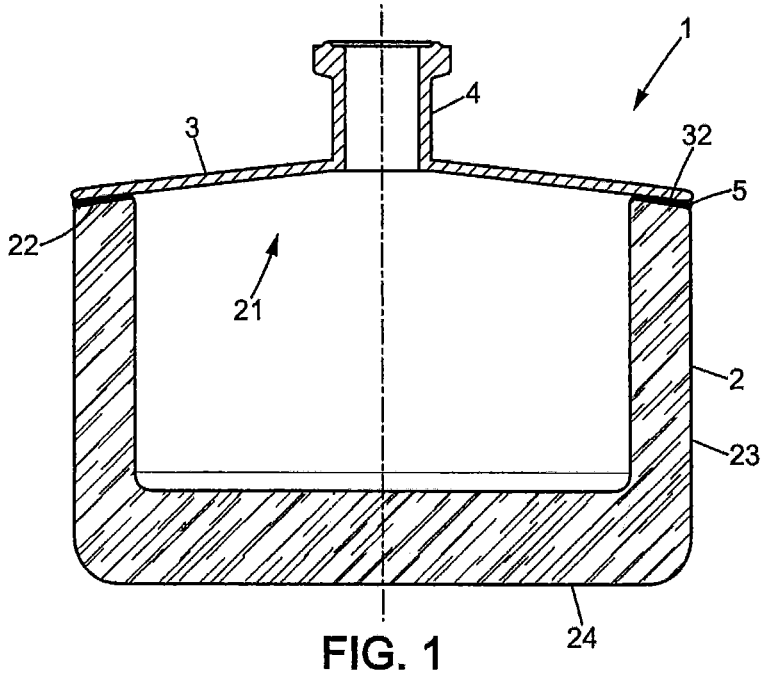
FIG. 1: a sectional view of one embodiment of a bottle with neck having a glass piece comprising a side wall and a base, and a flat rigid piece with a neck.

A bottle with neck having at least one container for liquid product will be described below with reference to FIGS. 1 to 33.

The bottle 1 comprises a glass piece 2, a rigid piece 3, and a neck 4 which may be made either on the glass piece 2 or on the rigid piece 3. The glass piece 2, the rigid piece 3, and the neck 4 give the bottle its external shape. The glass piece 2 and the rigid piece 3 are bonded to each other with an adhesive 5 to form the bottle 1, the adhesive ensuring the fluidtightness of the bottle 1. The adhesive 5 also ensures the mechanical strength of the bottle 1. Such adhesive solution enables simplification of the shape of the various parts of the bottle 1 to be assembled together, in contrast to a snap-closure solution which requires these parts to have complex shapes. Indeed, in case the glass piece has an opening, such an embodiment of the bottle does not require any external bead on the edge of the opening of the glass piece. This solution does neither require the rigid piece to have a skirt with a relief, the skirt having a shape complementary to the bead. In addition, no locking piece is necessary, thus reducing the number of elements to be provided to form the bottle and reducing the bulk and cost of the assembly solution.

The adhesive ensures a permanent bond. "Permanent" is understood to mean that the glass piece 2 and the rigid piece 3 cannot be detached from each other under normal conditions of use.

The adhesive 5 may be notably selected from:

two-component adhesives such as epoxy adhesives;

thermoplastic adhesives which are compositions mainly comprising a thermoplastic polymer such as an ionically crosslinked thermoplastic polymer (ionomer) of ethylene and an acid, for example Surlyn® which is a copolymer of ethylene and vinyl(methacrylic acid); and silicone adhesives.

Two-component adhesives have the advantage of meeting both the requirements of compatibility (the liquid product to be contained in the bottle does not deteriorate the adhesive) and neutrality (the adhesive does not release any compounds into the liquid product). These adhesives enable obtaining a very high degree of mechanical strength but have the disadvantage of requiring mixing at the time of application, thus complicating the manufacturing process. As these adhesives also have a longer complete curing time, it is best to ensure a minimum of at least fifteen minutes and preferably an hour or even a day of intermediate storage time before stressing the assembly, for example in subsequent operations of assembly, handling, or packaging. Thus, in case a high production rate is required, a thermoplastic adhesive or a silicone adhesive should therefore be preferred.

The thermoplastic adhesives preferably used in configurations having a sealing band (see below) are quick to cure and offer the advantage of being easy to handle and use and require no intermediate storage time. However, these adhesives are less versatile.

Finally, silicone adhesives are the preferred adhesives for this application. They offer fast polymerization time, do not require mixing at the time of application, and exhibit sufficient mechanical strength for the application. They provide a good fluidtight sealing which is maintained over time and offer the advantage of satisfying both the requirements of compatibility (the liquid product to be contained in the bottle does not deteriorate the adhesive) and neutrality (the adhesive does not release compounds into the liquid product).

However, it was not obvious for the skilled person to use this type of adhesive, particularly in cosmetics, perfumery, and food (packaging for liquids such as spirits). Indeed, silicone adhesives give off a pronounced odor of acetic acid that repels consumers of cosmetics, perfumes, and beverages, and can alter the olfactory and/or taste properties of these products.

However, the inventors have managed to overcome this preconception, because they have discovered that after a sufficiently long storage period, the odor fades until it is no longer noticeable to consumers and has no effect on the olfactory and/or taste properties of the products. Thus, by ensuring a sufficiently long storage period before sending it to packing, filling, and capping, generally at least a week or even two weeks, the disadvantage due to the acetic acid odor no longer applies.

The fluidtight properties of the adhesive can be measured in sealing degree. The sealing degree can be defined by leak testing. Such leak testing may for example comprise placing the bottle 1 filled with a reference liquid, for example water or glycerol, in a vacuum chamber in a predetermined orientation, for example where the content is in contact with the potential leakage area of the bottle 1, i.e. at the assembly between the glass piece 2 and the rigid piece 3. The ambient pressure in the chamber is gradually dropped at a predefined pace, the sealing degree being defined by the ambient pressure at which the content begins to leak from the bottle. Some embodiments disclosed herein can achieve a sealing degree of −800 millibar (mbar) or even −950 mbar relative to atmospheric pressure. In many applications, such a sealing degree is not required: it is sufficient to have a sealing degree reaching −350 mbar, preferably −400 mbar.

The glass piece 2 is mainly composed of glass. Any type of glass can be used that is compatible with the intended application, including types of glass already in use today in the bottle industry.

The glass piece 2 may form either a lower portion, an intermediate portion, an upper portion, or a side portion of the bottle 1. These terms are used to designate certain parts of the bottle when the bottle is arranged in the intended orientation for its storage or use. Preferably, the glass piece 2 forms the lower portion or upper portion of the bottle 1.

The glass piece 2 comprises an annular assembly surface 22. Throughout the present disclosure, the adjective "annular" is understood to mean "having the shape of a continuous closed curve, the curve possibly including angles." The so-called annular elements are therefore not necessarily circular.

The rigid piece 3 may form either a lower portion, an intermediate portion, an upper portion, or a side portion of the bottle 1. Throughout the present disclosure, "rigid" is understood to mean a material which cannot be deformed by the user under normal conditions of use. Preferably, the rigid piece 3 forms the upper portion or lower portion of the bottle 1. The rigid piece 3 comprises an annular assembly surface 32.

The rigid piece 3 may be made of various materials, including glass, metal (particularly stainless steel), and plastic (particularly a polyolefin such as polypropylene or polyethylene; a polyalkene terephthalate such as polybutylene terephthalate). In particular, a material compatible with and neutral to the intended content of the bottle is chosen.

Figure 21:
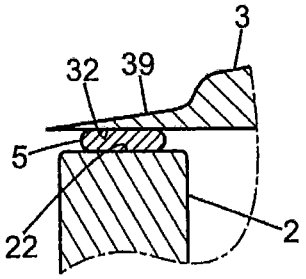
FIG. 21: a detail sectional view of the bottle at the assembly between the glass piece and the rigid piece, the rigid piece comprising a flange and the two pieces being bonded to each other with an adhesive.
Figure 22:
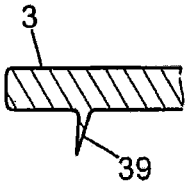
FIG. 22: a sectional view of another embodiment of the rigid piece with flange.

Generally, the annular assembly surface 32 of the rigid piece 3 can be provided on a flange 39 thereof (FIGS. 21 and 22). The flange 39 is a portion of the rigid piece 3 generally with a thickness thinner than that of the other portions of the rigid piece 3. The flange 33 preferably forms the outermost contour of the rigid piece 3 and extends substantially parallel to the surface of the rigid piece 3 (FIG. 21). Such a configuration is not required, however; it is sufficient that the flange 39 on which the annular assembly surface 32 is provided has a general shape that is symmetrical to that of the annular assembly surface 22 of the glass piece 2 through the bonding plane (this does not concern the shape of the surface but only the shape of its extension). For example, if it is desired that the rigid piece 3 extends laterally beyond the glass piece 2, the flange 39 does not form the outermost contour of the rigid piece 3 but projects beyond it, preferably perpendicularly to its surface (FIG. 22).$$

The shape and implementation of the annular assembly surface 22 are dependent on the shape of the glass piece 2.

Similarly, the shape and implementation of the annular assembly surface 32 are dependent on the shape of the rigid piece 3.

Various possible shapes for the glass piece 2 and the rigid piece 3 are described below with particular reference to FIGS. 3 to 12. The two pieces will be designated hereinafter by the term "piece". It is therefore understood that "piece" means "glass piece" or "rigid piece." The references for the various elements will have the number "2" as prefix when concerning the glass piece 2 and the number "3" when concerning the rigid piece 3.

Figure 4:
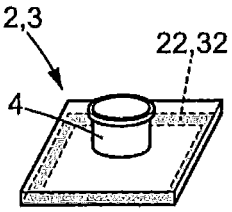
FIG. 4: a three-quarter view of a flat piece with a neck and an annular assembly surface, referenced in the table of FIG. 13 by the labels "P", "s/SAI", and "a/1C"; a variant (not shown) comprises two necks and is referenced in FIG. 13 by the labels "P", "s/SAI", and "a/2C"

The piece 2, 3 may have a generally flat shape (FIGS. 3 and 4); the annular assembly surface 22, 32 is an annular surface which follows the contour of the generally flat shape; it may be on one of the flat faces of the piece 2, 3, or on the edge. The adjective "flat" is understood to mean any implementation in which the variation from the flatness represented by a midplane is less than 15%, preferably less than 10%, or even 5%, of the largest of the dimensions of the glass piece 2. A neck 4 may be provided on the flat-shaped piece 2, 3 (FIG. 4). Once assembled, the neck 4 may be oriented outwardly or inwardly with respect to the bottle 1. Alternatively, two necks may be provided on the flat-shaped piece 2, 3 (not shown in the figures, but referred to in the table of FIG. 13 by the labels "P", "a/SAI", and "a/2C").

Figure 5:
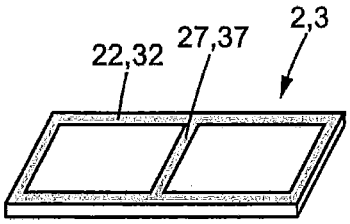
FIG. 5: a three-quarter view of a flat piece with no neck having an annular assembly surface and an intermediate assembly surface, referenced in the table of FIG. 13 by the labels "P", "a/SAI", and "s/C"
Figure 6:
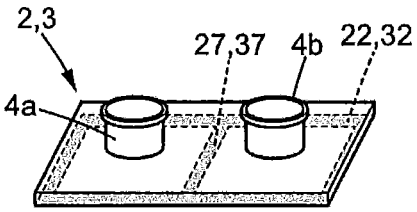
FIG. 6: a three-quarter view of a flat piece with two necks, an annular assembly surface, and an intermediate assembly surface, referenced in the table of FIG. 13 by the labels "P", "a/SAI", and "a/2C"

As a variant concerning the flat shape of the piece 2, 3, the piece may further comprise an intermediate assembly surface 27, 37 inside the ring formed by the annular assembly surface 32 on the contour of the rigid piece 3 (FIG. 5). Such a piece 2, 3 enables enclosing another piece 3, 2 with an intermediate wall 36, 26 and a top 35, 25 with two necks 4*a*, 4*b* as described below). Alternatively, such a piece 2, 3 may comprise two necks 4*a*, 4*b* one on each side of the intermediate assembly surface 27, 37 (FIG. 6). This variant illustrated in FIG. 6 enables enclosing another piece 3, 2 with an intermediate wall 36, 26 and a single bottom 34, 24 to form two adjacent containers 2*a*, 2*b* with their openings 21*a*, 21*b* oriented in the same direction and which will be described in more detail below.

In another example, the piece 2, 3 may have a domed or vaulted shape with a neck 4 at its top opposite an opening 21, 31. Once assembled, the neck 4 may be oriented inwardly or outwardly with respect to the bottle 1. The annular assembly surface 22, 32 is then on the periphery of the opening 21, 31 of the piece 2, 3, either on the inner surface of the piece, the outer surface of the piece, or on the projecting surface (rim) of the piece. Alternatively, the dome or vault may have two necks at its top. Additionally or alternatively, the piece comprises a flange having a side facing in the same direction as the dome or vault. The annular assembly surface is then on this side facing in the same direction as the dome or vault.

Figure 7:
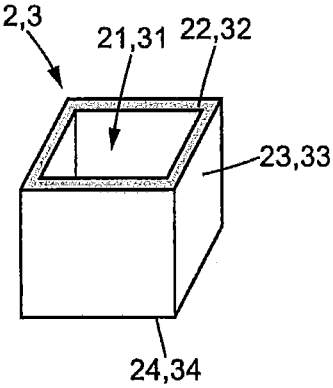
FIG. 7: a three-quarter view of a piece comprising a side wall, a base, and an annular assembly surface, referenced in the table of FIG. 13 by the labels "PL", "s/PI", and "a/1F"
Figure 8:
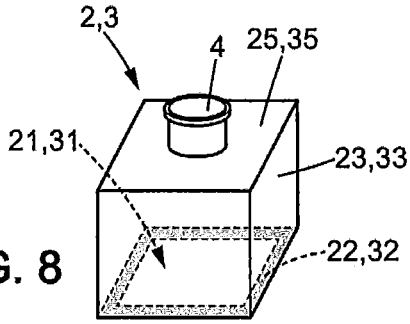
FIG. 8: a three-quarter view of a piece comprising a side wall, a top, and an annular assembly surface, referenced in the table of FIG. 13 by the labels "PL", "s/PI", and "a/1D1C"; a variant (not shown) comprises two necks and is referenced in FIG. 13 by the labels "PL", "s/PI", and "a/1D2C"

In another example, the piece 2, 3 has a side wall 23, 33 which closes on itself to form a space, and at least one opening 21, 31 (FIGS. 7 and 8). The annular assembly surface 22, 32 is on the perimeter of the opening 21, 31, on the rim of the side wall 23, 33 surrounding the opening 21, 31. "Perimeter of the opening" 21, 31 is understood here to mean the inner or outer surface of the end of the side wall 23, 33 around the opening 21, 31. What is referred to as the "rim" is the end surface substantially perpendicular to the side wall 23, 33 which surrounds the opening 21, 31. When the piece 2, 3 is an intermediate piece, two opposite rims are therefore present and the piece 2, 3 then comprises two annular assembly surfaces 22, 32, each on an end of the piece 2, 3.

The piece 2, 3 with the side wall 23, 33 may have a base 24, 34 extending the side wall 23, 33; in other words, the base 24, 34 and side wall 23, 33 are made as one piece, for example when the piece 2, 3 forms the lower portion of the bottle 1 (FIG. 7). What is referred to as the "base" is a solid wall physically delimiting, in one direction, the space formed by the side wall 23, 33, and which is opposite to the opening 21, 31. The base 24, 34 is generally the wall on which the bottle 1 rests when it is arranged in its normal storage position once filled.

The piece 2, 3 with the side wall 23, 33 may alternatively have a top 25, 35 extending the side wall 23, 33; in other words, the top 25, 35 and side wall 23, 33 are made as one piece, for example when the piece forms the upper portion of the bottle 1. A neck 4 is formed on the top 25, 35 (FIG. 8). What is referred to as the top 25, 35 is thus a wall in which a neck 4 is formed. The neck 4 can be oriented towards the outside or inside of the bottle 1. The opening 21, 31 is then located opposite to the top 25, 35. Alternatively, the top may have two necks (not shown in the figures, but referenced in the table of FIG. 13 by the labels "PL", "s/PI", and "a/1D2C").

In yet another example, the piece 2, 3 has a side wall 23, 33 which closes on itself to form a space, and an intermediate wall 26, 36 arranged inside the space and separating the latter into two space portions. The side wall 23, 33 and the intermediate wall 26, 36 are formed as one piece. The two space portions are distinct, meaning that in the normal storage position of the bottle 1 once filled, a liquid product contained in one of the two space portions cannot flow into the other space portion, and vice versa.

Figure 16:
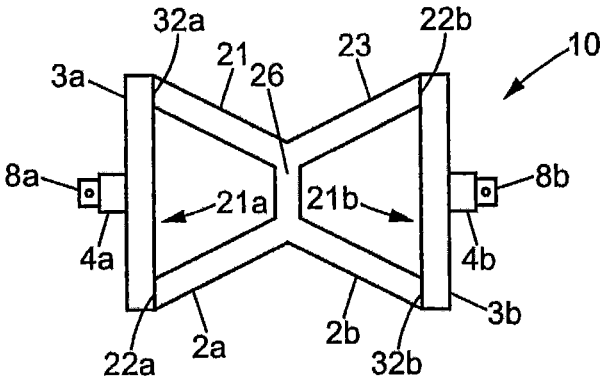
FIG. 16: a front view of a packaging device with a dispenser and a bottle comprising a glass piece (respectively rigid piece) having a side wall, an intermediate wall forming the base of two containers, and two rigid pieces (respectively glass), each being flat with a neck.

The two space portions separated by the intermediate wall 26, 36 may each form a container 1*a*, 1*b* (FIG. 16). In this case, the intermediate wall 26, 36 is the bottom of the two containers, opposite their respective openings 21*a*, 21*b*; 31*b*, 31*b*. In other words, this embodiment can be described as two containers 1*a*, 1*b* formed as one piece and connected to one another by their base. The piece 2, 3 then comprises two separate assembly surfaces 22*a*, 22*b*; 32*a*, 32*b* each located on the periphery of one of the openings 21*a*, 21*b*.

Figure 9:
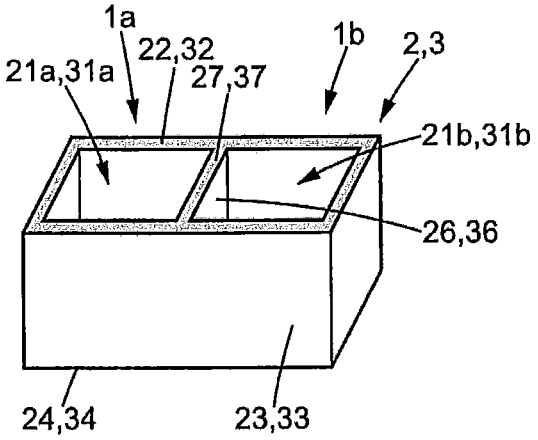
FIG. 9: a three-quarter view of a piece comprising a side wall, an intermediate wall, a single base, an annular assembly surface, and an intermediate assembly surface, referenced in the table of FIG. 13 by the labels "PL", "a/PI", and "a/1F"
Figure 10:
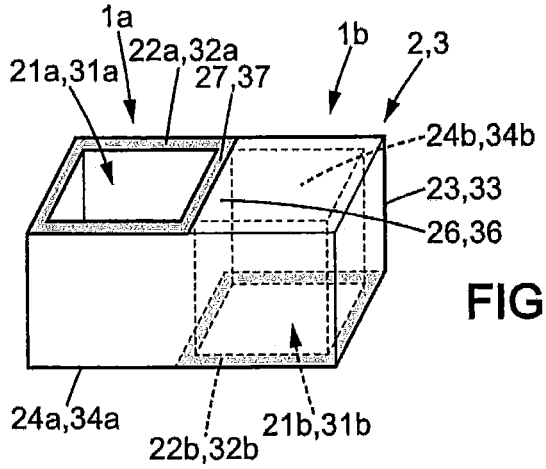
FIG. 10: a three-quarter view of a piece comprising a side wall, an intermediate wall, two bases, and two annular assembly surfaces, referenced in the table of FIG. 13 by the labels "PL", "a/PI", and "a/2F"

The two space portions separated by the intermediate wall 26, 36 can each form a container 1*a*, 1*b* when at least one additional base 24, 34 is provided, the intermediate wall 26, 36 and side wall 23, 33 then having the same height where they are connected to each other (FIGS. 9 and 10). In the case of a single base (FIG. 9), the containers 1*a*, 1*b* open in the same direction and are side by side. The single base 24, 34 is integral with the side wall 23, 33 and the intermediate wall 27, 37 so as to form the containers 1*a*, 1*b*. The intermediate wall 26, 36 and the single base 24, 34 then contribute to the fluidtightness between the two containers 1*a*, 1*b*. In other words, this embodiment can be described as two containers 1*a*, 1*b* formed as one piece and connected to each other by the intermediate wall 26, 36, the openings 21*a*, 21*b*; 31*a*, 31*b* being oriented in the same direction. The piece 2, 3 then has an annular assembly surface 22, 32 on the free end of the side wall 23, 33, and an intermediate assembly surface 27, 37 on the free end of the intermediate wall 26, 36. The assembly surfaces may be present either on the rim of the corresponding wall, or for the side wall 23, 33 an inner or outer surface of its free end, or for the intermediate wall 26, 37 the two opposite surfaces of its free end. In the case of two bases 24*a*, 24*b*; 34*a*, 34*b* (FIG. 10), the containers 1*a*, 1*b* open in different directions, for example opposite directions. In other words, this embodiment can be described as two containers 1*a*, 1*b* formed as one piece and connected head-to-tail to one another by the intermediate wall 26, 36. The piece 2, 3 then has two annular assembly surfaces 22*a*, 22*b*; 32*a*, 32*b*, each with two portions: one portion on the free end of the side wall 23, 33 and another portion on one of the bases 24, 34.

Figure 11:
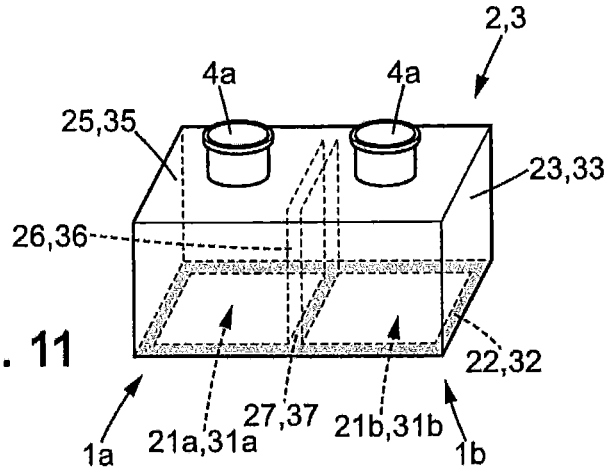
FIG. 11: a three-quarter view of a piece comprising a side wall, an intermediate wall, a top with two necks, an annular assembly surface, and an intermediate assembly surface, referenced in the table of FIG. 13 by the labels "PL", "a/PI", and "a/1D"
Figure 12:
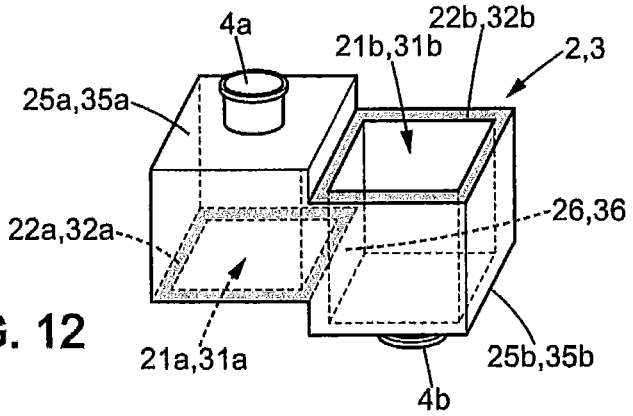
FIG. 12: a three-quarter view of a piece comprising a side wall, an intermediate wall, two tops, and two annular assembly surfaces, referenced in the table of FIG. 13 by the labels "PL", "a/PI", and "a/2D"

Alternatively, the base or bases 24, 24*a*, 24*b*, 34, 34*a*, 34*b* are replaced by one or tops 25, 25*a*, 25*b*, 35, 35*a*, 35*b* formed as one piece with the side wall 23, 33. The arrangement of the annular 22, 22*a*, 22*b*, 32, 32*a*, 32*b* and intermediate assembly surface(s) 27, 37 remains identical to that described above but with the base or bases replaced by one or more tops (FIGS. 8, 11, and 12).

Of all of these variants, the preferred embodiments for the glass piece 2 are those where the glass piece 2 has a side wall 23 forming an opening 21 and where the opening 21 has a maximum projected surface area of at least 10 $cm^2$, preferably at least 50 $cm^2$. "Maximum projected surface area" is understood to mean the maximum surface area obtained by projecting the opening 21 onto a plane.

Furthermore, the opening 21 and the neck 4 must be distinguished when both are present on the glass piece 2. An opening 21 is always bordered by the annular assembly surface 22 and possibly the intermediate assembly surface 27.

The outer shape of the piece 2, 3, and in particular its opening or openings, may have various forms, for example a prismatic shape (for example cubic; parallelepipedal, in particular rectangular; rhombohedral; triangle-based, etc.), spherical (full or truncated), conical (in particular with flat circular or polygonal base, or spherical base), cylindrical (in particular with circular or polygonal base), etc. Preferably, the glass piece 2 has an opening or openings of a shape that is not rotationally symmetrical.

Figure 28:
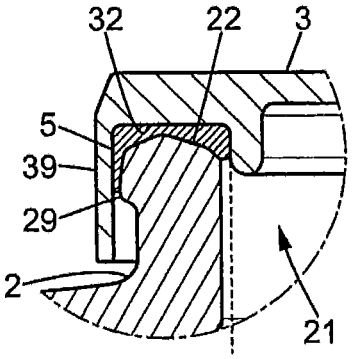
FIG. 28: a detail sectional view of the bottle at the assembly between the glass piece and the rigid piece, where the glass piece has a bead and a convex assembly surface at the periphery of its opening.

The adhesive solution has a considerable advantage here over the snap-fitted solution of the prior art, because the shape of the assembly surfaces is of little consequence. Indeed, the adhesion of the glass piece 2 with the rigid piece 3 does not require any special shapes: it is only needed to have assembly surfaces to be assembled together which have extension areas of complementary shapes. As for the shapes of their surfaces, they are not necessarily complementary since the adhesive enables to overcome any surface discrepancies in the shape. Moreover, the shapes of their surfaces can be varied, although the simplest shape is a flat shape. For example, FIG. 28 shows a glass piece 2 having a bead 29 at its opening 21, such as the one of the snap-fitted prior art solution. The assembly surface 22, 27 has a convex shape. However, the rigid piece 3 does not need any relief on its skirt 39.

Figure 29:
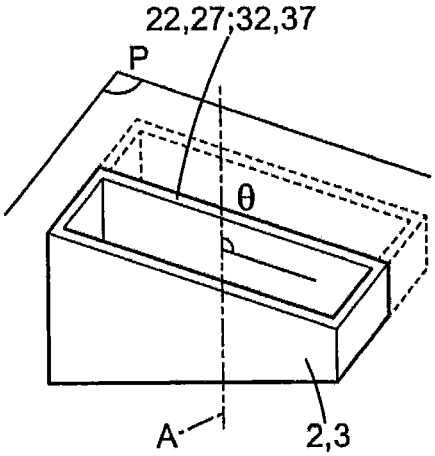
FIG. 29: a three-quarter view of a piece comprising an assembly surface having a shape which does not lie in a plane perpendicular to a general longitudinal axis of the bottle, but in a plane forming an angle different from 90° with the general longitudinal axis of the bottle.
Figure 30:
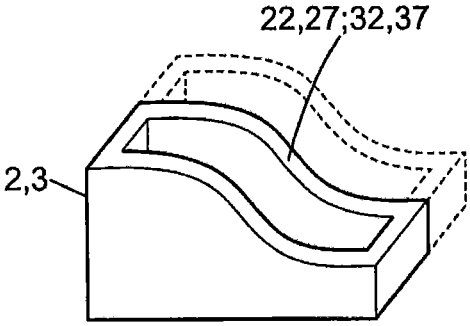
FIGS. 30 and 31: three-quarter views of a piece comprising an assembly surface having a shape that cannot lie in a plane.
Figure 31:
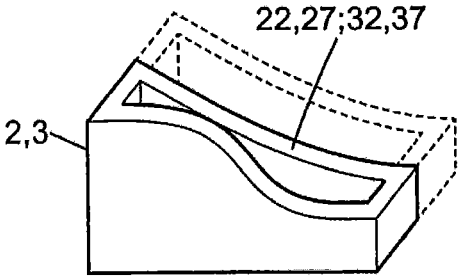

In the figures, each assembly surface is represented as being on the rim of the corresponding wall. This is not a limitation; as noted above, an assembly surface can be implemented on any surface of a free end of the walls. In addition, in most of the figures each assembly surface is represented in a form that can lie in a single plane perpendicular to a general longitudinal axis of the bottle 1. Of course, this is purely illustrative and the possible embodiments are not limited to this mode. For example, as illustrated in FIG. 29, the assembly surface 22, 27; 32, 37 may have a shape that does not lie in a plane perpendicular to the general longitudinal axis of the bottle 1, but in a plane P forming an angle θ that is not 90° with the general longitudinal axis of the bottle 1. In another example illustrated in FIGS. 30 and 31, the assembly surface 22, 27; 32, 37 may have a shape that cannot lie in a plane.

Some exemplary bottles 1 are shown in FIGS. 1 (also FIG. 14), 2 (also FIGS. 17), 15 and 16.

The bottle 1 in FIG. 1 (also visible in FIG. 14) is formed by the assembly of a glass piece 2 with a rigid piece 3 which are bonded to each other with adhesive. The glass piece 2 has a side wall 23, an opening 21 bounded by the side wall 23, and a base 24. The base 24 is rectangular with rounded corners and is opposite to the opening. The side wall 23 is a right cylinder with the base 24 forming the closed curve of its directrix. The opening 21 is bordered by the annular assembly surface 22 of the glass piece 2 which is therefore also of rectangular shape with rounded corners. The rigid piece 3, which is preferably of plastic, metal, or glass, has a flat shape and possesses a neck 4. The neck 4 is centered relative to the rigid piece 3. The annular assembly surface of the rigid piece follows the edge thereof. It has the same shape as the annular assembly surface 22 of the glass piece 2. An adhesive 5 is placed between the annular assembly surfaces 22, 32. The process may be for example a cold bonding process.

Figure 2:
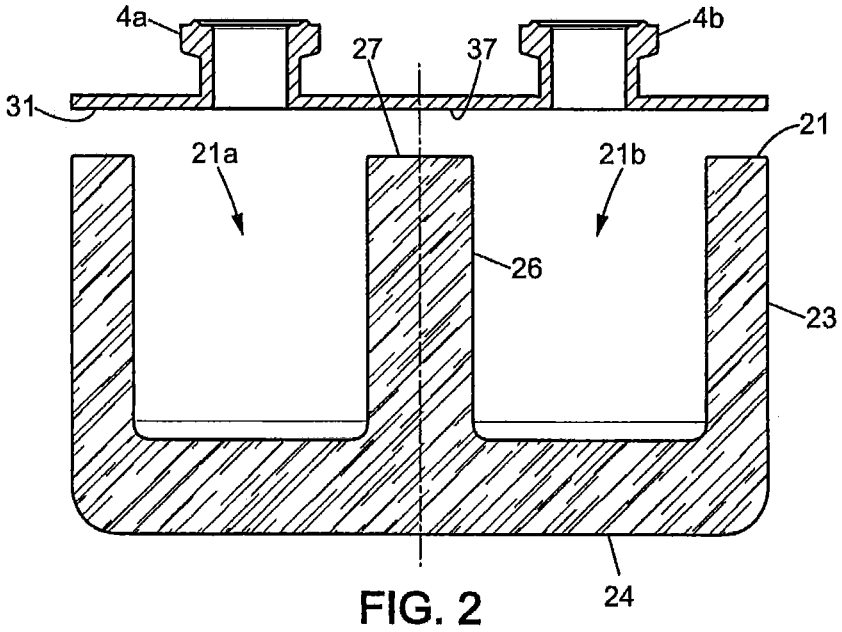
FIG. 2: a sectional view of another embodiment of the bottle with neck having a glass piece comprising a side wall, an intermediate wall, and a single base, and a flat rigid piece with two necks.
Figure 3:
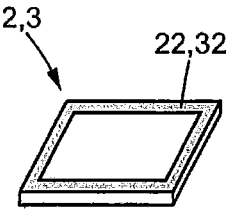
FIG. 3: a three-quarter view of a flat piece with no neck having an annular assembly surface, referenced in the table of FIG. 13 by the labels "P", "s/SAI", and "s/C"

The bottle 1 in FIG. 2 which has a planar symmetry (also visible in FIG. 17) is formed by assembling a glass piece 2 with a rigid piece 3 which are bonded to each other using the adhesive. The glass piece 2 has a side wall 23, an intermediate wall 26 forming with the side wall 23 two containers 1*a*, 1*b*, two openings 21*a*, 21*b* defined by the side wall 23 and the intermediate wall 26, and a single base 24. The single base 24 is rectangular with rounded corners and is opposite to the openings 21*a*, 21*b*. The side wall 23 is a right cylinder with the single base 25 forming the closed curve of its directrix. The openings 21*a*, 21*b* are bordered by the annular assembly surface 22 and the intermediate assembly surface 27 of the glass piece 2. The annular assembly surface 22 is therefore also of rectangular shape with rounded corners. The rigid piece 3, which is preferably of plastic, metal, or glass, has a flat shape and possesses two necks 4*a*, 4*b*. Each of the necks 4*a*, 4*b* is centered relative to the corresponding opening 21*a*, 21*b* of the corresponding glass piece 2. The rigid piece 3 comprises an annular assembly surface which follows its outer edge and an intermediate assembly surface corresponding to that of the glass piece. An adhesive is placed between the annular assembly surfaces 22, 32 on the one hand, and the intermediate assembly surfaces 27, 37 on the other.

Figure 15:
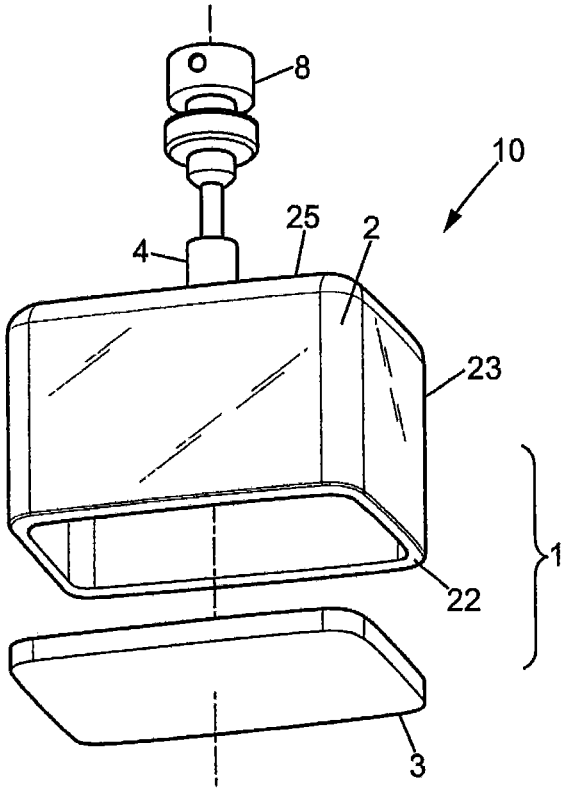
FIG. 15: an exploded three-quarter view of a packaging device with a dispenser and a bottle comprising a flat rigid piece and a glass piece having a side wall and a top with a neck.

The bottle 1 of FIG. 15 is formed by assembling a glass piece 2 with a rigid piece 3 which are bonded to each other using adhesive. The glass piece 2 has a side wall 23, an opening 21 defined by the side wall 23, and a top 25 comprising a neck 4. The top 25 is rectangular with rounded corners and is opposite the opening 21, the neck 4 being centered with respect to the top 25. The side wall 23 is a right cylinder with the top 25 forming the closed curve of its directrix. The opening 21 is bordered by the annular assembly surface 22 of the glass piece 2 which is therefore also rectangular with rounded corners. The rigid piece 3, which is preferably of plastic, metal, or glass, has a flat shape. An adhesive 5 is placed between the annular assembly surfaces 22, 32.

Other geometrical combinations of the glass and rigid pieces are summarized in the table in FIG. 13, where:

"P" refers to the planar form of the pieces;

"PL" refers to embodiments with a side wall;

"s/SAI" and "a/SAI" respectively refer to the embodiments without and with an intermediate assembly surface;

"s/PI" and "a/PI" respectively refer to the embodiments without and with an intermediate wall;

"s/C" and "a/nC" respectively refer to the embodiments without neck and with neck, n indicating the number of necks (1 or 2);

"a/(n)F" refers to embodiments with base, the number of bases being indicated where appropriate by n where n=1 or 2, noting that embodiment "a/1F" corresponds to a side-by-side configuration, and embodiment "a/2F" corresponds to a head-to-tail configuration of the containers;

"a/(n)D" refers to the embodiments with a top, the number of tops being indicated where appropriate by n where n=1 or 2, noting that embodiment "a/1D" comprises two necks on the top and corresponds to a side-by-side configuration, and embodiment "a/2D" corresponds to a head-to-tail configuration of the containers;

"a/1DnC" refers to the embodiments with a top and one or two necks, the number of necks being indicated by n;

"Non" (no) means that the combination is not possible;

"Oui" (yes) means that the combination is possible;

" . . . x2" means that the bottle comprises two pieces designated by the reference located before the multiplication sign: for example "a/1C×2" means that the bottle comprises two pieces designated by the reference "a/1C".

Figure 18:
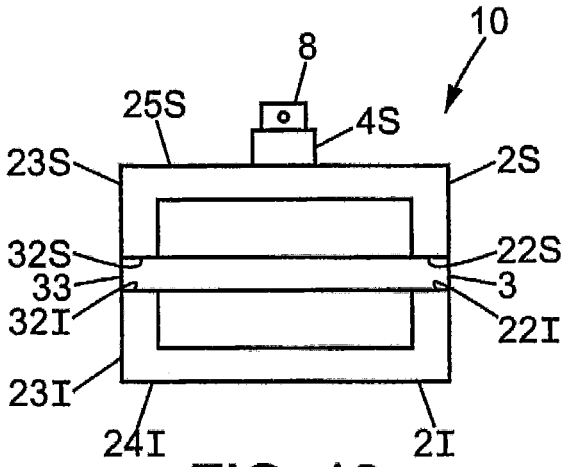
FIG. 18: a front view of a packaging device with a dispenser and a bottle comprising a lower portion made of a glass piece (respectively rigid piece) having a side wall and a base, an intermediate portion made of a flat rigid piece (respectively glass piece) with no neck, and an upper portion made of a glass piece (respectively rigid piece) having a side wall and a top with a neck.

The table of FIG. 13 does not show all possible combinations, particularly those with a piece forming an intermediate portion of the bottle 1. For example, a rigid piece 3 forms the intermediate piece of the bottle 1, this rigid piece 3 having a side wall 33 (FIG. 18). Thus, the rigid piece 3 comprises two annular assembly surfaces 32I, 32S one on each side of the side wall 33: a lower annular assembly surface 32I and an upper annular assembly surface 32S. The bottle 1 comprises a glass piece 2I forming the lower portion of the bottle 1 and a glass piece 2S forming the upper portion of the bottle 1. The glass piece 2I forming the lower portion comprises a side wall 23I forming an opening 21I, an annular assembly surface 22I, and a base 24I. The annular assembly surface 22I of the glass piece 2I forming the lower portion is bonded with an adhesive to the lower annular assembly surface 32I of the rigid piece 3. The glass piece 2S forming the upper portion comprises a side wall 23S forming an opening 21S, an annular assembly surface 22S, and a top 25S with a neck 4S. The annular assembly surface 22S of the glass piece 2S forming the upper portion is bonded with an adhesive to the upper annular assembly surface 32S of the rigid piece 3. In another example (not shown), the rigid piece is replaced by a glass piece and each of the glass pieces is replaced by a rigid piece.

Figure 19:
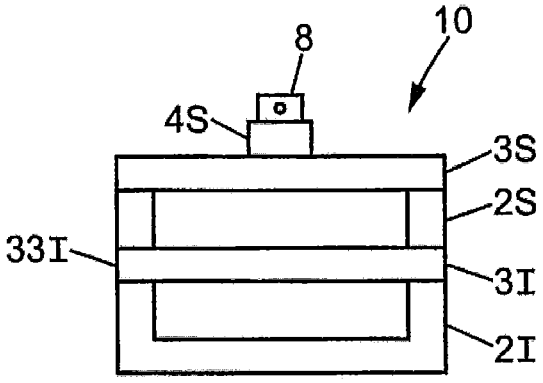
FIG. 19: a front view of a packaging device with a dispenser and a bottle comprising a lower portion made of a glass piece (respectively rigid piece) having a side wall and a bottom, a first intermediate portion made of a flat rigid piece (respectively glass piece) with no neck, a second intermediate portion made of a glass piece (respectively rigid piece) having a side wall, and an upper portion made of a flat rigid piece (respectively glass piece) with a neck.

Another exemplary embodiment not appearing in the table of FIG. 13 is a bottle 1 comprising a lower portion made of a glass piece 2I having a side wall 23I and a base 24I, a first intermediate portion made of a rigid piece 3I having a side wall 33I, a second intermediate portion made of a glass piece 2S having a side wall 23S, and an upper portion made of a flat rigid piece 3S with a neck 4S (FIG. 19).

The outer shape of the glass piece or pieces 2 is preferably substantially identical to that of the rigid piece or pieces 3, but this is optional. What matters is the shape of the assembly surfaces 22, 32 of the glass piece 2 and the rigid piece 3 which must match, in other words must be substantially identical.

Figure 20A:
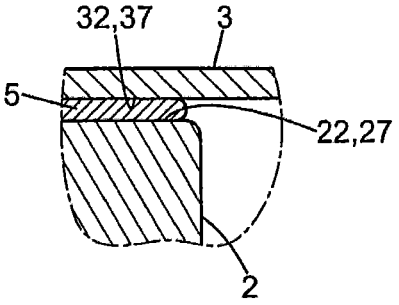
FIGS. 20A and 20B: a detail sectional view of the bottle at the assembly between the glass piece and the rigid piece, the two pieces being bonded to each other with an adhesive, the glass piece being respectively with and without a shoulder.
Figure 20B:
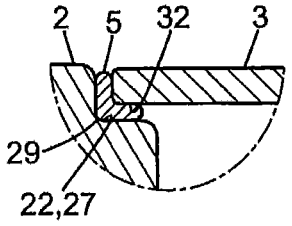

The assembly surface 22, whether annular or intermediate, of the glass piece 2 may be implemented so as to face the corresponding assembly surface 32 of the rigid piece 3 once the bottle is assembled. The adhesive 5 is then placed therebetween. For example, one piece is placed on the other, and the adhesive is applied between the two pieces as illustrated in FIG. 20A with the rigid piece 3 arranged above the glass piece 2 and with the adhesive 5 placed between the two pieces 2, 3 on their respective assembly surfaces 22, 32; 27, 37. Of course, the two pieces can be reversed in the drawing of FIG. 20A. In another example, one piece has a shoulder at the rim of a wall, the shoulder then forming the assembly surface of the piece. An edge of the other piece providing an assembly surface is fitted into the shoulder and the adhesive 5 is arranged between this edge and the shoulder. Since the shoulder is formed by at least two surfaces joining at an angle, it is possible to create the assembly surface on only one or the other of these surfaces, or on both at once. This variant is illustrated by FIG. 20B which shows a glass piece 2 having a shoulder 29 and a rigid piece 3 whose edge is fitted into the shoulder 29. The adhesive 5 is placed between the assembly surface 22, 27 of the glass piece 2 (here both surfaces of the shoulder) and the assembly surface 32 of the rigid piece 3. Here again, it is possible to reverse the two pieces in the Figure.

Figure 23:
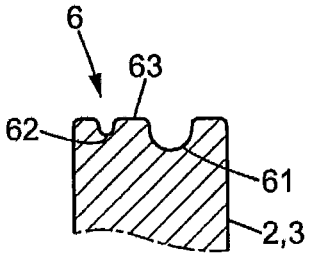
FIG. 23: a detail sectional view of one of the pieces of the bottle, showing a glue trap with a filling groove and an overflow groove.
Figure 24:
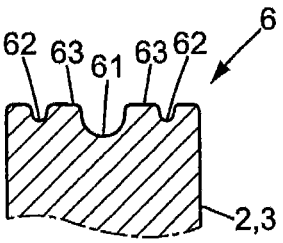
FIG. 24: a detail sectional view of one of the pieces of the bottle, showing a glue trap with a filling groove and two overflow grooves one on each side of the filling groove.
Figure 25:
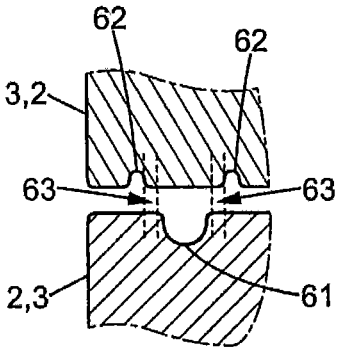
FIG. 25: a detail sectional view of the bottle, showing a glue trap where the filling groove, on the one hand, and the overflow grooves, on the other hand, are not created on the same piece.

In this particular case, at least one of the assembly surfaces 22, 27, 32, 37 may comprise a glue trap 6 (FIGS. 23 and 24). The glue trap 6 advantageously has a filling groove 61 and at least one overflow groove 62 at a distance from the filling groove 61. A bonding surface 63 is then formed between the filling groove 61 and the overflow groove 62. The filling groove 61 and the overflow groove 62 are substantially concentric. The filling groove 61 is provided for depositing the adhesive 5 before the bonding step. The overflow groove 62 is provided for receiving the overflow of adhesive 5 which spreads from the filling groove 61 towards the overflow groove 62. Once the glass piece 2 and rigid piece 3 are assembled and bonded to each other, the adhesive 5 is then located in the filling groove 61 and possibly in the overflow groove 62 and on the bonding surface 63, which ensures contact between the glass piece 2 and the rigid piece 3. Preferably, an overflow groove 62 is provided on both sides of the filling groove 61, there thus being two bonding surfaces 63 one on either side of the filling groove 61 (FIG. 24). Alternatively, the glue trap 7 is divided into two assembly surfaces which face each other 22, 32; 27, 37, meaning each of the two assembly surfaces 22, 32; 27, 37 only receives a portion of the glue trap 7 (FIG. 25). For example, the filling groove 61 is provided on one of the assembly surfaces 22, 32; 27, 37 and the overflow groove 62 is provided on the other assembly surface 32, 22; 37, 27. A bonding surface 63 still exists: it is formed by the portions of the assembly surfaces between the filling groove 61 and the overflow groove 62 when the glass piece 2 and the rigid piece 3 are assembled and bonded to each other.

The glue trap 6 not only ensures that the adhesive 5 does not overflow, but also increases the bonding surface area without increasing the bonding width, in other words the thickness of the wall on the rim of which the adhesive is deposited. In particular, given the possibly different nature of the materials of the glass piece 2 and the rigid piece 3, and taking into account the nature of the adhesive 5, it is possible that the adhesive 5 will adhere better to one of the pieces. The creation of a suitably dimensioned glue trap 6 on the piece which does not bond as well with the adhesive 5 thus substantially balances the bonding of the adhesive on the possibly different materials of the two pieces.

The shape of the glue trap 6 corresponds to the assembly surface 22, 27, 32, 37 on which it is provided, meaning that it is annular if the assembly surface is an annular assembly surface 22, 32; it is rectilinear if the assembly surface is on a rectilinear surface, for example in some cases for an intermediate assembly surface 27, 37.

Alternatively, an assembly surface of the glass piece and the assembly surface of the corresponding rigid piece do not face each other, but are arranged side by side, oriented in the same direction and lying substantially in the same plane. To achieve this, the glass piece comprises, at the rim of its side wall 23 or its intermediate wall 27, a shoulder 29 which extends to have the same shape as that of the corresponding assembly surface. The shoulder 29 is located closer to the opening 21 than the corresponding assembly surface. The shoulder 29 serves to receive the edge of the rigid piece 3. The height of the shoulder 29 is substantially equal to the thickness of the edge of the rigid piece 3 which may be a flange.

Figure 26:
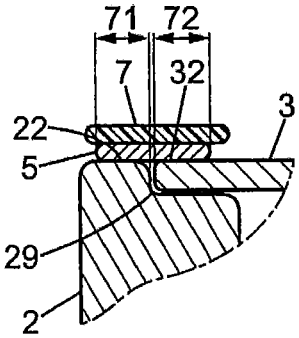
FIG. 26: a detail sectional view of the bottle at the assembly between the glass piece and the rigid piece, where the bonding is achieved using a sealing band and the same adhesive for the two pieces.
Figure 27:
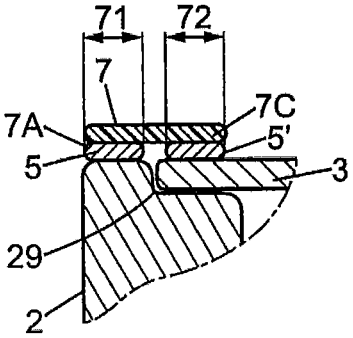
FIG. 27: a detail sectional view of the bottle at the assembly between the glass piece and the rigid piece, where the bonding is achieved using a sealing band and two different adhesives, one for the glass piece and one for the rigid piece.

Bonding is achieved using a sealing band 7 (FIGS. 26 and 27). This sealing band 7 has the same shape as that of the assembly surfaces to which it is applied. It has a width at least equal to the sum of the widths of the two assembly surfaces. Thus, similarly to the annular assembly surfaces 22, 32, the sealing band 7 is annular and comprises two concentric annular portions 71, 72, a first sealing portion 71 which is in contact with the annular assembly surface 22 of the glass piece 2 and a second sealing portion 72 which is in contact with the annular assembly surface 32 of the rigid piece 3. The adhesive 5 is placed between the first sealing portion 71 and the annular assembly surface 22 of the glass piece 2. Contact between the second sealing portion 72 and the annular assembly surface 32 is ensured either with the same adhesive 5 (FIG. 26) or with a different adhesive 5' (FIG. 27). In the case of intermediate assembly surfaces 27, 37, the sealing band 7 preferably has the same shape, meaning it is rectilinear if the intermediate assembly surfaces 27, 37 are rectilinear. The band has the same elements as described above. In this case, there must be one rigid piece per opening of the glass piece.

The sealing band 7 is preferably a laminate with at least one support layer 7S and one adhesion layer 7A. The support layer 7S may be of paper, plastic, or metal (for example aluminum). The adhesive or adhesives 5, 5' form the adhesion layer 7A. Such an embodiment of the sealing band 7 enables simplification of the manufacturing process since it exempts from the step of depositing adhesive on the annular assembly surfaces 22, 32, which may have complex shapes.

In the case where one of the pieces is a flat piece, the sealing band 7 may not be annular and may cover the entire outer surface of the flat piece.

The description of the variants with sealing band 7 can be modified to swap the glass piece 2 and the rigid piece 3.

Figure 32:
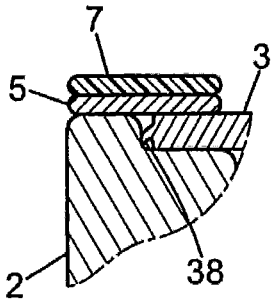
FIGS. 32 and 33: detail view of a rigid piece respectively comprising one and two sealing lips.
Figure 33:
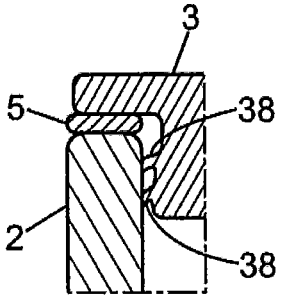

The fluidtight seal can be reinforced when the rigid piece 3 is a plastic piece. To this aim, a sealing lip 38 is provided on the rigid piece 3 for this purpose. The sealing lip 38 is annular and extends along the annular assembly surface 32, and possibly along the intermediate assembly surface 37 of the rigid piece 3 (FIG. 32). The sealing lip 38 is arranged further inwards than the assembly surface 32, 37 relative to the bottle 1. This sealing lip 38 is adapted to form a sealing line against the side wall 23, and possibly the intermediate wall 26, of the glass piece 2. A plurality of sealing lips may be provided, in which case they are superimposed parallel to the wall with which they are in contact once the bottle 1 is assembled (FIG. 33). In this particular embodiment, the rigid piece is made of a plastic material having a certain capacity to conform. "Certain capacity to conform" is understood here to mean a plastic that creeps to conform to the shape of the glass piece in which it has been forcibly fitted. Suitable plastics include those which allow achieving a sealing degree of −350 mbar, preferably −400 mbar. The rigid piece 3 is then dimensioned so that the sealing lip or lips 38 are compressed against the surface or surfaces facing them, at the time of assembly.

The annular assembly surfaces 22, 32 of the glass piece 2 and the rigid piece 3 may be oriented collinearly to a direction of assembly of the glass piece 2 with the rigid piece 3.

Alternatively, the annular assembly surfaces 22, 32 of the glass piece 2 and the rigid piece 3 are oriented in a direction forming a substantially non-zero acute angle, preferably substantially equal to 90°, with a direction of assembly of the glass piece 2 with the rigid piece 3.

All embodiments described above are compatible with the inevitable presence of geometrical defects inherent to the manufacturing tolerances in the production processes used, which lead in particular to the impossibility of having complete control over the shape of the pieces and in particular the glass piece 2. These defects can result in deviations from the desired shape of the piece of less than 10%, preferably less than 5%, more preferably less than 3% of the largest dimension of the glass piece 2. The present invention makes it possible to easily compensate for these production defects because the adhesive 5 allows filling in the local variations in distance between the annular assembly surfaces 21, 31 that face each other.

The bottle 1 described above can be used to create a packaging device 10 for a liquid product. Such a packaging device 10 further comprises a dispenser 8 in addition to the bottle 1. The dispenser 8 is used to dispense from the bottle 1 the liquid product contained therein. Any dispenser 8 can be used that is suitable for the product contained in the bottle 1. Alternatively, the packaging device 10 may have two dispensers 8, in particular dispensers of different types or of the same type but with different dispensing capacities. If one of the pieces of the bottle has an intermediate wall, the packaging device 10 has two dispensers 8*a*, 8*b* in order to dispense the contents from each of the containers 1*a*, 1*b* of the bottle 1.

Examples of such a packaging device 10 are illustrated in FIGS. 2 and 15 to 20.

Figure 14:
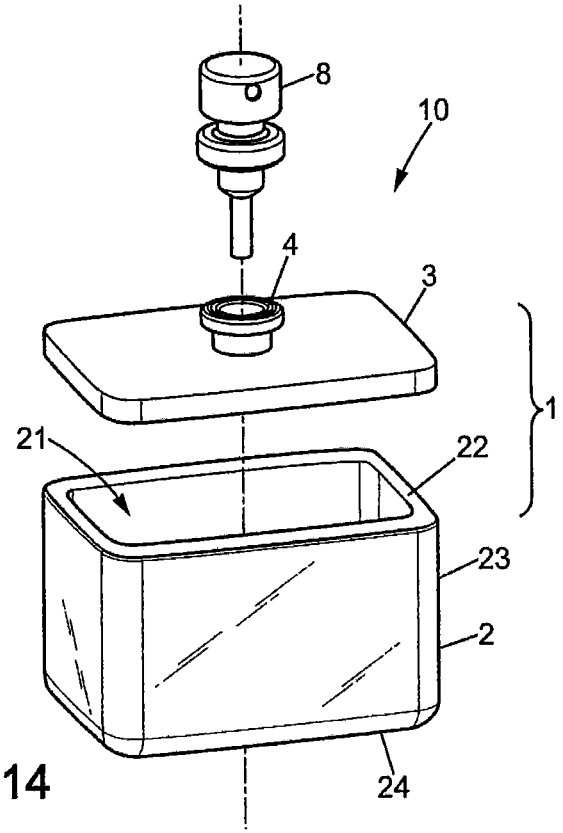
FIG. 14: an exploded three-quarter view of a packaging device with a dispenser and a bottle comprising a glass piece having a side wall with a base, and a flat rigid piece having a top with a neck.

The packaging device 10 of FIG. 14 comprises a bottle 1 which has already been described above. The dispenser 8 is a pump having a tube 81 which is inserted into the bottle 1 through the neck 4 and is fixed to the neck 4 by a known method such as crimping.

The packaging device 10 of FIG. 15 comprises a bottle 1 which has already been described in detail above. The dispenser 8 is a pump having a tube 81 which is inserted into the bottle 1 through the neck 4 and is fixed to the neck 4 by a known method such as crimping.

The packaging device 10 of FIG. 16 comprises a bottle 1 which has been described in detail above, and two dispensers 8*a*, 8*b*. Each dispenser 8*a*, 8*b* is a pump having a tube 81*a*, 8*b* which is inserted into the bottle 1 through a corresponding neck 4*a*, 4*b* and is fixed to the neck 4 by a known method such as crimping.

Figure 17:
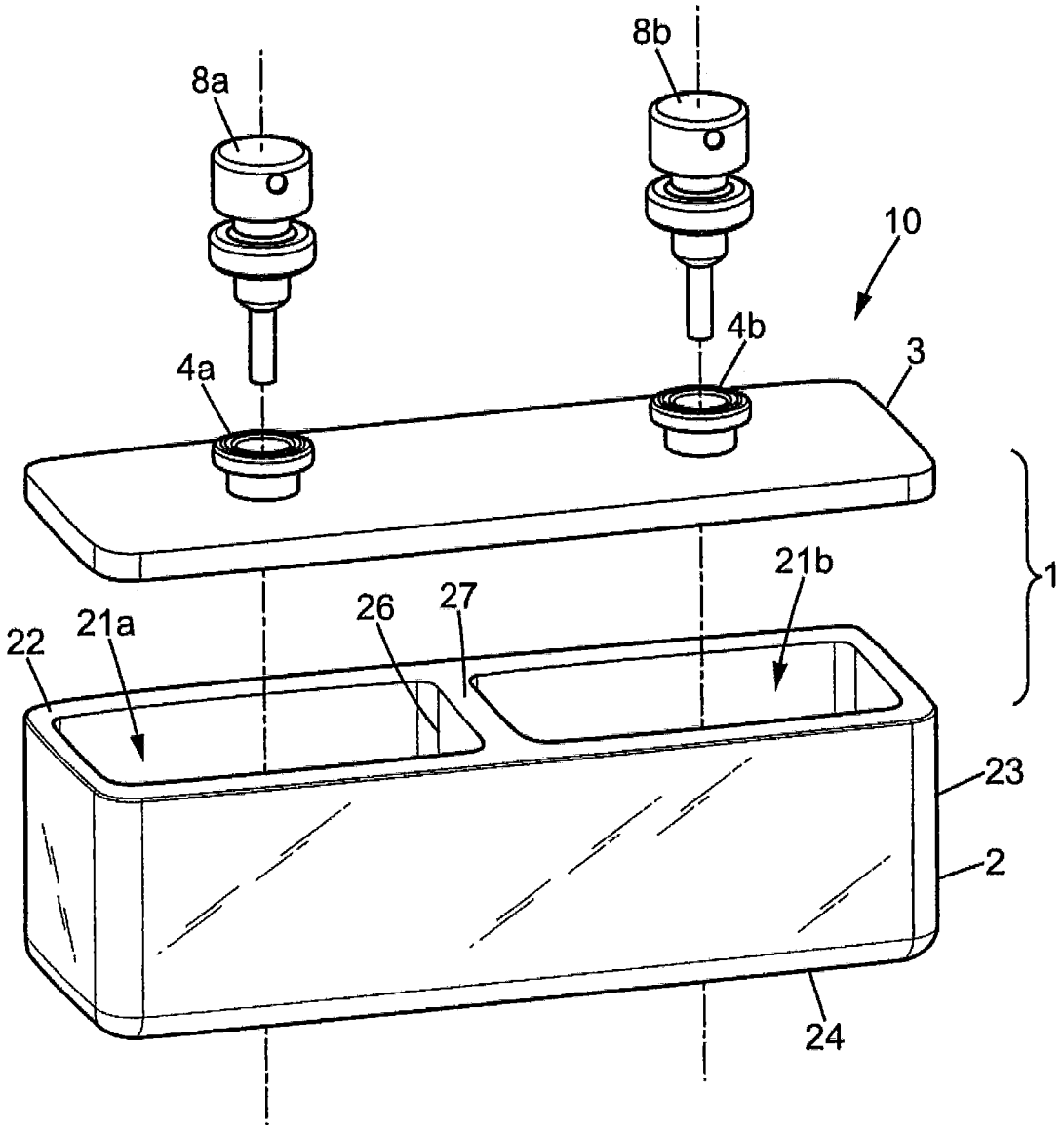
FIG. 17: an exploded three-quarter view of a packaging device with two dispensers and a bottle comprising a glass piece having a side wall, an intermediate wall, and a single base, and a flat rigid piece having two necks.

The packaging device 10 of FIG. 17 comprises a bottle 1 which has been described in detail above. The packaging device comprises two dispensers 8*a*, 8*b*, each being a pump having a tube 81*a*, 8*b* which is inserted into the bottle 1 through a corresponding neck 4*a*, 4*b* and is fixed to the neck 4 by a known method such as crimping.

The packaging device 10 of FIG. 18 comprises a bottle 1 which has been described in detail above, and a dispenser 8. The dispenser 8 is a pump having a tube 81 which is inserted into the bottle 1 through the neck 4 and is fixed to the neck 4 by a known method such as crimping.

The packaging device 10 of FIG. 19 comprises a bottle 1 which has been described in detail above, and a dispenser 8. The dispenser 8 is a pump having a tube 81 which is inserted into the bottle 1 through the neck 4 and is fixed to the neck 4 by a known method such as crimping.

A method for manufacturing the bottle 1 is described below.

First, the method comprises providing a glass piece. The glass piece can be manufactured in various ways. Preferably, the glass piece is obtained by pressing. For pressing, a die cavity and a forming punch together forming a space to receive a glass gob are used. The forming punch is movable relative to the die cavities, between a retracted position and an extended position in which the formed space defines the future shape of the glass piece.

In the particular case where the glass piece has a side wall and therefore an opening, this opening is wide to allow passage of the forming punch. The forming punch defines the internal shape of the glass piece, and the die cavities its external shape. The die cavity has an opening through which the forming punch is inserted, a side wall giving shape to the side wall of the glass piece. In the case of a glass piece with a base, the die cavity also has a base surface. In the case of a glass piece with a top, the die cavity provides a bottom portion for forming the neck.

Where appropriate, the pressing step described above is followed by a blowing step, during which the pressed piece is deformed by blowing into its inside volume. This blowing step can increase the inside volume of the glass piece by about 10% to 20%, if one wants to maintain the geometrical properties of the inside surface that were obtained during the pressing step. The term "pressed" as used herein covers any implementation comprising a pressing step, including the case where it is followed by a blowing step.

The method also comprises providing a rigid piece. The rigid piece can be manufactured in various ways depending on the material in which it is made. For example, if the rigid piece is made of glass, it can be manufactured by the pressing method described above. If the rigid piece is made of plastic or metal, molding and/or machining methods may be used. Rolling methods may also be used.

Subsequent steps of the method are dependent on whether or not a sealing band is used.

In the case where no sealing band is used, the glass piece and the rigid piece are assembled and bonded together. For this purpose, adhesive is applied to the assembly surface or surfaces of one or both among the glass piece and the rigid piece (in the case where a glue trap is provided, the adhesive is placed in the filling groove; the amount of adhesive is then chosen so that after assembly of the glass piece with the rigid piece, the adhesive does not spread beyond the overflow groove or grooves). The assembly surface or surfaces of the glass piece are therefore placed in contact with the assembly surface or surfaces of the rigid piece and then held there for the time needed for the adhesive to begin to adhere (meaning to dry, harden, or polymerize).

In the case where a sealing band is used, adhesive is placed either on the band or on the assembly surface or surfaces of the glass piece or rigid piece. The sealing band and/or the glass piece and/or the rigid piece are held in place for the time needed for the adhesive to begin to adhere (meaning to dry, harden, or polymerize).

One will note that this manufacturing method is much simpler than a manufacturing method in which various elements must be snap-fitted together.

The method further comprises the storage of the bottles. This storage period is necessary when the adhesive used is an adhesive that has a strong odor, such as epoxy adhesives and silicone adhesives, in order to allow the odor to fade. The storage time is preferably at least one week, more preferably at least two weeks. The bottle is then filled.

The bottle can be used in the manufacture of a packaging device. For this, a dispenser is assembled on each neck of the bottle. This assembly can be done after filling.

The invention claimed is:

1. A bottle with neck for a liquid product having an external shape, comprising:

a glass piece, said glass piece having an annular assembly surface;

a rigid piece having an annular assembly surface;

a neck formed on the glass piece or rigid piece;

an adhesive providing a fluidtight seal between the annular assembly surface of the glass piece and the annular assembly surface or the rigid piece, thereby ensuring the fluidtight seal, the glass piece, rigid piece, and neck giving the bottle its external shape;

a glue trap on the annular assembly surface of either the glass piece or the rigid piece or is divided between the glass piece and the rigid piece, the glue trap having a filling groove for depositing adhesive, at least one bonding surface, and at least one overflow groove, the filling groove, the bonding surface, and the overflow groove being substantially concentric, and the filling groove and the overflow groove being narrower than the width of the annular assembly surface of both the glass piece and the rigid piece, wherein the filling groove and the overflow groove are independently depressed from the annular assembly surface of the glass piece or the rigid piece and away from the edges thereof.

2. The bottle according to claim 1, wherein the glass piece comprises a side wall, an annular edge of which forms an opening, the annular assembly surface being located on the annular edge forming the opening.

3. The bottle according to claim 2, wherein the annular edge forming the opening has a shoulder in which is formed the annular assembly surface.

4. The bottle according to claim 1, wherein the adhesive is a silicone adhesive.

5. The bottle according to claim 1, wherein the annular assembly surface of the glass piece faces the annular assembly surface of the rigid piece, and the adhesive is placed therebetween.

6. The bottle according to claim 5, wherein the rigid piece comprises an annular flange on which is provided the annular assembly surface of the rigid piece.

7. The bottle according to claim 1, wherein the annular assembly surfaces of the glass piece and rigid piece are oriented collinearly to a direction of assembly of the glass piece with the rigid piece.

8. The bottle according to claim 1, wherein the annular assembly surfaces of the glass piece and the rigid piece are oriented in a direction forming an acute angle that is substantially non-zero with a direction of assembly of the glass piece with the rigid piece.

9. The bottle according to claim 8, wherein the acute angle is substantially equal to 90°.

10. The bottle of claim 1, wherein the filling groove and the overflow groove are provided on and away from the edge of the annular assembly surface of the glass piece.

11. The bottle of claim 1, wherein the filling groove and the overflow groove are provided on and away from the edge of the annular assembly surface of the rigid piece.

12. The bottle of claim 1, wherein the filling groove is provided on and away from the edge of the annular assembly surface of either one of the glass piece and rigid piece and the overflow groove is provided on and away from the annular assembly surface of the other one of the glass piece and rigid piece.

13. A packaging device for a liquid product, comprising a bottle and a dispenser of liquid product, wherein the bottle is a bottle with a neck for a liquid product having an external shape and comprising:

a glass piece, said glass piece having an annular assembly surface;

a rigid piece having an annular assembly surface;

a neck formed on the glass piece or rigid piece;

an adhesive providing a fluidtight seal between the annular assembly surface of the glass piece and the annular assembly surface of the rigid piece, thereby ensuring the fluidtight seal, the glass piece, rigid piece, and neck giving the bottle its external shape; and a glue trap on the annular assembly surface of either the glass piece or the rigid piece or is divided between the glass piece and the rigid piece, the glue trap having a filling groove for depositing adhesive, at least one bonding surface, and at least one overflow groove, the filling groove, the bonding surface, and the overflow groove being substantially concentric, and the filling groove and the overflow groove being narrower than the width of the annular assembly surfaces of both the glass piece and the rigid piece, wherein the filling groove and the overflow groove are independently depressed from the annular assembly surface of the glass piece or the rigid piece and away from the edges thereof.

14. A bottle with a neck for a liquid product having an external shape, comprising:

a glass piece, said glass piece having an annular assembly surface;

a rigid piece having an annular assembly surface;

a neck formed on the glass piece or rigid piece;

an adhesive providing a fluidtight seal between the annular assembly surface of the glass piece and a sealing annular strip, the sealing annular strip being securely connected to the annular assembly surface of the rigid piece, thereby ensuring the fluidtight seal;

wherein the sealing annular strip comprises two concentric annular portions, a first sealing portion sealed to the annular assembly surface of the glass piece and a second sealing portion sealed to the annular assembly surface of the rigid piece, the annular assembly surfaces of the glass piece and the rigid piece being substantially adjacent, substantially in the same plane and adhering to the same side of the sealing annular strip, the glass piece, rigid piece, and neck giving the bottle its external shape.

* * * * *